US006187491B1

(12) United States Patent
Ferrar et al.

(10) Patent No.: US 6,187,491 B1
(45) **Date of Patent: *Feb. 13, 2001**

(54) ELECTROPHOTOGRAPHIC CHARGE GENERATING ELEMENT CONTAINING ACID SCAVENGER IN OVERCOAT

(75) Inventors: Wayne T. Ferrar, Fairport; J. Robin Cowdery, Webster; William T. Gruenbaum; David S. Weiss, both of Rochester, all of NY (US)

(73) Assignee: Eastman Kodak Company, Rochester, NY (US)

( * ) Notice: This patent issued on a continued prosecution application filed under 37 CFR 1.53(d), and is subject to the twenty year patent term provisions of 35 U.S.C. 154(a)(2).

Under 35 U.S.C. 154(b), the term of this patent shall be extended for 0 days.

This patent is subject to a terminal disclaimer.

(21) Appl. No.: 09/246,639

(22) Filed: Feb. 8, 1999

(51) Int. Cl.[7] ..... G03G 5/047; G03G 5/147

(52) U.S. Cl. ..... 430/58.2; 430/58.1; 430/58.65; 430/58.75; 430/66; 430/67; 430/18; 428/195

(58) Field of Search ..... 430/66, 67, 58.1, 430/58.2, 58.65, 58.75, 9.18; 428/195, 9, 18

(56) References Cited

U.S. PATENT DOCUMENTS

| | | | |
|---|---|---|---|
| 3,542,544 | 11/1970 | Seus et al. . | |
| 4,050,935 | 9/1977 | Limburg et al. . | |
| 4,297,425 | 10/1981 | Pai et al. . | |
| 4,330,608 | 5/1982 | Limburg et al. | 430/512 |
| 4,457,994 | 7/1984 | Pai et al. | 430/64 |
| 4,874,682 | 10/1989 | Scott et al. | 430/56 |
| 5,368,967 | 11/1994 | Schank et al. | 430/66 |
| 5,688,961 | 11/1997 | Kushibiki et al. | 430/76 |
| 5,693,442 | 12/1997 | Weiss et al. | 430/66 |
| 5,712,360 | 1/1998 | Kobayashi et al. | 528/38 |
| 5,731,117 | 3/1998 | Ferrar et al. | 430/66 |
| 5,824,443 | 10/1998 | Kushibiki et al. | 430/73 |

FOREIGN PATENT DOCUMENTS

| | | |
|---|---|---|
| 0 771 805 A1 | 5/1997 | (EP) . |
| 0 771 809 A1 | 5/1997 | (EP) . |

*Primary Examiner*—Janis L. Dote
(74) *Attorney, Agent, or Firm*—James L. Tucker

(57) ABSTRACT

Electrophotographic charge generating elements comprise a solid electrolyte layer having improved image discrimination. The solid electrolyte layer includes a complex of a silsesquioxane and a charge carrier, and further includes nondiffusible acid scavengers in an amount of at least 0.2 weight %. The acid scavengers are nondiffusible tertiary arylamines having a pKa of at least 4.

22 Claims, No Drawings

ELECTROPHOTOGRAPHIC CHARGE GENERATING ELEMENT CONTAINING ACID SCAVENGER IN OVERCOAT

CROSS-REFERENCE TO RELATED APPLICATIONS

This application is related to application Ser. No. 09/222,639, filed Dec. 30, 1998, by Ferrar et al. for ELECTROPHOTOGRAPHIC CHARGE GENERATING ELEMENT CONTAINING PRIMER LAYER, now U.S. Pat. No. 6,066,425. This application is also related to co-pending application Ser. No. 09/223,429, filed Dec. 30. 1998 pending, by Ferrar et al. for SILSESQUIOXANE ELECTROLYTIC COMPOSITION AND ELECTROPHOTOGRAPHIC CHARGE GENERATING ELEMENT CONTAINING SAME.

FIELD OF THE INVENTION

This invention relates to electrophotographic charge generating elements containing a silsesquioxane (siloxane polymer) and a nondiffusible acid scavenger in an overcoat or solid electrolyte layer. This invention is particularly useful in the field of electrophotography.

BACKGROUND OF THE INVENTION

Charge transporting elements generally comprise a support and a charge transport layer across which charge moves under certain conditions. Charge transporting elements include electrophotographic charge generating elements.

In the use of such charge generating elements (also known as electrophotographic elements), incident light induces a charge separation across the various layers of the element. The electron and hole of an electron-hole pair produced within a charge generating layer separate and move in opposite directions to develop a charge between an electrically conductive layer and an opposite surface of the element. The charge forms a pattern of electrostatic potential (also referred to as an electrostatic latent image). The electrostatic latent image can be formed by a variety of means, for example, by imagewise radiation-induced discharge of a uniform potential previously formed on the surface. Typically, the electrostatic latent image is then developed into a toner image by contacting the latent image with an electrographic developer and the toner image is then fused to a receiver material. If desired, the latent image can be transferred to another surface before development or the toner image can be transferred before fusing.

The requirements of the process of generating and separating charge place severe limitations on the characteristics of the layers in which charge is generated and holes and/or electrons are transported. For example, many such layers are very soft and subject to abrasion. This places severe constraints upon the design of charge generating elements. Some configurations cannot provide a reasonable length of service unless an abrasion resistant overcoat layer (also known as "overcoat") is provided over the other layers of the element. This presents its own problems since charge must be able to pass through the overcoat.

The resistivity of an overcoat has major consequences in an electrophotographic system. If the overcoat has high resistivity, the time constant for voltage decay will be excessively long relative to the processing time for the electrophotographic element and the overcoat will retain a residual potential after photodischarge of the underlying photoreceptor. The magnitude of the residual potential depends upon the initial potential, the dielectric constants of the various layers, and the thickness of each layer.

A solution to this problem has been to reduce the thickness of the overcoat. Another solution is to provide an overcoat that is conductive. The overcoat must, however, not be too conductive. The electrophotographic element must be sufficiently electrically insulating in the dark that the element neither discharges excessively nor allows an excessive migration of charge along the surface of the element. An excessive discharge ("dark decay") would prevent the formation and development of the electrostatic latent image. Excessive migration causes a loss of resolution of the electrostatic image and the subsequent developed image. This loss of resolution is referred to as "lateral image spread" (evidenced as "image width"). The extent of image degradation will depend upon processing time for the electrophotographic element and the thickness and resistivities of the layers. It is thus desirable to provide an overcoat that is neither too insulating nor too conductive.

Silsesquioxanes are siloxane polymers, sometimes represented by the formula $(RSiO_{1.5})_z$, that are commonly prepared by the hydrolysis and condensation of trialkoxysilanes. Some of the polymers have been modified by the inclusion of polyethers or polydialkyloxysilanes. Generally, coatings of such materials are between 0.5 to 10 $\mu$m thick and are applied from aqueous alcohol solvent systems. They have been commercially available from a number of sources for years (for example from Dow Corning, General Electric and Optical Technologies). A number of patents describe the use of such polymers to provide abrasion-resistant coatings for various purposes [see for example U.S. Pat. No. 4,027,073 (Clark), U.S. Pat. No. 4,159,206 (Armbuster et al), U.S. Pat. No. 4,277,287 (Frye), U.S. Pat. No. 4,324,712 (Vaughn, Jr.), U.S. Pat. No. 4,407,920 (Lee et al) and U.S. Pat. No. 4,923,775 (Schank)]. Typical uses of such polymers include scratch resistant coatings on acrylic lenses, photoreceptors and transparent glazing materials, and as overcoats for electrophotoconductive elements. For example, U.S. Pat. No. 4,159,206 (noted above) describes the use of neutral-charged, durable coating compositions that include colloidal silica and a mixture of dialkyldialkoxysilanes and alkyltrialkoxysilanes in a methanol/water solvent system. The mixture of silanes is believed to react to form silsesquioxanes.

Useful silsesquioxane-containing overcoats are described for example in U.S. Pat. No. 5,731,117 (Ferrar et al) and U.S. Pat. No. 5,693,442 (Weiss et al). In such layers, charge transport is provided by the presence of a charge canner that is complexed with the silsesquioxane.

Solid electrolytes (also known as solid ionic conductors) are solid materials in which electrical conductivity is provided by the motion of ions not electrons. A variety of solid electrolytes are inorganic crystals. Others are complexes of organic polymers and salts, such as complexes of poly (ethylene oxide) and alkali metal salts [see for example, Cowie et al, *Annu. Rev. Phys. Chem.,* Vol. 40, (1989) pp. 85–113, Shriver et al, *Chemical and Engineering News,* Vol. 63, (1985) pp. 42–57, Tonge et al, Chapter 5 *Polymers for Electronic Applications,* ed. Lai, CRC Press, Boca Raton, Fla., 1989, pp. 157–210, at 162, and Cowie, *Integration of Fundamental Polymer Science and Technology,* Vol. 2, Elsevoir Publisher, New York, 21.5 (1988), pp. 54–62].

Electrical surface conductivities for polymeric and inorganic solid ion conductors are in the range of about $1\times10^{-8}$ to 10 $(\text{ohms/square})^{-1}$ [Surface conductivity is equal to conductivity divided by thickness and is expressed as $(\text{ohms/square})^{-1}$]. Surface resistivity is equal to resistivity divided by thickness as expressed in ohms/square. For example, a resistivity of $1\times10^{14}$ ohms-cm for a layer having a thickness of 5 $\mu$m, equates to a surface resistivity of $2\times10^{17}$.

Copending and commonly assigned U.S. Ser. No. 09/223,429 filed by Ferrar, Yoerger, Cowdery, Sinicropi, Parton and Weiss on Dec. 30, 1998, and entitled "Silsesquioxane Electrolytic Composition and Electrophotographic Charge Generating Element Containing Same", and U.S. Ser. No. 09/222,639 by Ferrar, Sorriero, Cowdery and Weiss on Dec. 30, 1998, now U.S. Pat. No. 6,066,425, and entitled "Electrophotographic Charge Generating Element Containing Primer Layer", describe improved electrophotographic charge generating elements that include overcoats containing silsesquioxane salt complexes. Such overcoats provide considerable advantages in resistance to damage from physical handling, corona discharge or other radiation sources, gases such as ozone, and chemicals such as nitric acid. If desired, the overcoats can be adhered to underlying photoconductor charge generating layers with improved primer layer formulations.

Heretofore, acid scavengers have been added to organic photoconductor layers only, as described for example in U.S. Pat. No. 5,368,967 (Schank et al). These layers are generally insulators that carry charge when either holes or electrons are injected into them. In the materials described in this patent, hydroxy-substituted triphenylmethane compounds are used as stabilizers to protect charge transport agents such as hydroxyarylamines.

In addition, EP-A-0 771,805, EP-A-0 771,809, U.S. Pat. No. 5,824,443 (Kushibiki et al), U.S. Pat. No. 5,688,961 (Kushibiki et al), and U.S. Pat. No. 5,712,360 (Kobayashi et al) describe the incorporation of triarylamines into the sol-gel network of siloxanes to provide charge transport.

There is a need, however, to further protect the electrophotographic charge generating elements containing silsesquioxane salt complexes from corona charging and to improve resistance to lateral image spread. We have found that this is possible with the present invention as described in more detail below.

SUMMARY OF THE INVENTION

The problems noted above have been overcome with an electrophotographic charge generating element comprising, in order:

a) an electrically conductive layer, b) a photoconductor charge generating layer, and c) a solid electrolyte layer comprising a silsesquioxane salt complex, and at least 0.2 weight % of a nondiffusible acid scavenger that is a tertiary arylamine having a pKa of at least 4 in water.

This invention also provides a developed electrophotographic element comprising the electrophotographic charge generating element described above and a deposited image of electrophotographic toner.

We have discovered that the incorporation of certain non-diffusible tertiary arylamines as acid scavengers into the silsesquioxane salt overcoats of the electrophotographic charge generating elements improves the resistance to lateral image spread resulting from corona discharge. This advantage is particularly noticeable after multiple use of the element. Thus, image discrimination is preserved with this invention even after multiple images are generated.

In addition, the solid electrolyte layer also provides good resistance to abrasion, reduced brittleness and desired charge transport properties.

The non-diffusible acid scavenger used to provide these advantages in the silsesquioxane salt overcoat has several properties that are essential to its desired function. It is non-diffusible meaning that it does not readily migrate within or out of the solid layer containing the silsesquioxane. It is an "acid scavenger" meaning that it is basic in nature, having a pKa of at least 4 when dissolved or dispersed within water. The acid scavenger is also soluble in the silsesquioxane solid phase as well as a solvent-based formulation used to provide the overcoat layer. These and other features of these compounds, and their use and manufacture are described below in considerable detail.

DETAILED DESCRIPTION OF THE INVENTION

The present invention is based upon the novel use of particular tertiary arylamines as acid scavenger in the silsesquioxane salt overcoat or solid electrolyte layer in electrophotographic charge generating elements. Because the silsesquioxanes are present in the form of complex salts, the overcoat also carries a charge predominantly from the complex salt, not from the acid scavenger.

The charge generating elements of the invention comprise an electrically conductive layer, a charge generating layer, and a solid electrolyte layer as a charge transporting layer. The elements can additionally comprise a separate support, but the support can also be the electrically conductive layer. The noted layers are preferably used in charge generating elements that are configured as electrophotographic elements. These elements are capable of charging positively or negatively and can take a wide variety of forms, as discussed in greater detail below.

In the charge generating elements of the invention, a charge generating layer overlies the electrically conductive layer. The solid electrolyte layer overlies any optional primer layer that overlies the charge generating layer. The resulting element is described herein as if the element is in the shape of a horizontally disposed flat plate. It is to be understood, however, that the element is not limited to any particular shape and that directional terms refer only to relative positions, not to an absolute orientation relative to the environment. The solid electrolyte layer, for convenience, is also referred to herein as the overcoat of the charge generating element. This terminology should not be understood as limiting the scope of the charge generating element, nor even necessarily implying that the overcoat is uppermost, although this is highly preferred.

Generally, the solid electrolyte layer has a thickness of at least 0.5 and preferably at least 1 $\mu$m, and generally up to 10 $\mu$m. The other layers of the element (besides the primer layer that is described below) can have a thickness that would be conventional in the art, as taught for example in U.S. Pat. No. 5,731,117 (noted above) which is incorporated herein by reference for details of such conventional layers.

The solid electrolyte layer comprises a complex of a silsesquioxane and a charge carrier, both of which are defined in more detail below. The prefix "sesqui-" refers to a one and one-half stoichiometry of oxygen and the "siloxane" indicates a silicon containing material. Silsesquioxane can thus be represented by the general structure $(RSiO_{1.5})_z$ wherein R is an organic group and "z" represents the number of repeating units. This formula, which is sometimes written as $\{Si(O_{1/2})_3R\}_z$, is a useful shorthand for Silsesquioxanes, but, except as to fully cured silsesquioxanes, it does not fully characterize the materials. This is important since silsesquioxanes can be utilized in an incompletely cured state. An additional nomenclature is described in U.S. Pat. No. 5,731,117 (noted above) and by Glaser et al, *J. Non-Crystalline*

*Solids,*113 (1989) 7387. This nomenclature uses the initials "M", "D", "T" and "Q" to designate silicon atoms in various silyl units bonded to 1, 2, 3 or 4 atoms, respectively.

As used herein "silsesquioxane" refers to both the conventional polymers described in the art as well as "modified silsesquioxanes" that are prepared by copolymerizing various siloxanes. Examples of conventional silsesquioxanes are illustrated with Structure II below, and examples of modified silsesquioxanes are illustrated in Structures I and IV below.

While the silsesquioxanes used in the present invention can exist and be used in various states of curing, they can be identified by their state of curing. The state of curing generally refers to the number of hydrolyzable groups that have been reacted in the polymer matrix. In preferred embodiments, partially cured polymers are used because of the thermal sensitivities of underlying layers. For example, in Structure I below, the silyl units present at "m" mole percent (or m' units) can have a state of curing identified as $T^0$, $T^1$, $T^2$ and $T^3$ as defined by the publication by Glaser et al. Fully cured silsesquioxanes are $T^3$. In partially cured polymers, substantially all silyl units are $T^2$ or $T^3$. Thus, the extent of curing can be quantified as the ratio of $T^2$ to $T^3$, which ratio decreases with increased curing.

In addition, the silyl units present at "n" mole percent in Structures I and IV can be designated as $D^1$ or $D^2$, depending upon their state of curing, as described by Glaser et al. Similarly, the ratio of $D^1$ to $D^2$ is indicative of the state of curing and decreases with an increase in curing. "D" silyl units may be present in the solid electrolyte layer if not covalently bound to the silsesquioxane.

In general, the molar ratio of carbon atoms to silicon atoms in the silsesequioxane polymers used in the practice of this invention is at least 1.1:1. Preferably, the molar ratio is at least 1.2:1.

The silsesquioxanes useful in the present invention can be generally represented by the following Structure I:

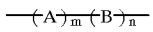

wherein -A- is represented by Structure Ia:

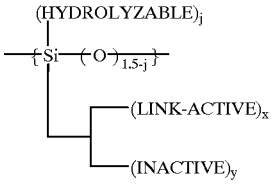

and -B- is represented by Structure Ib:

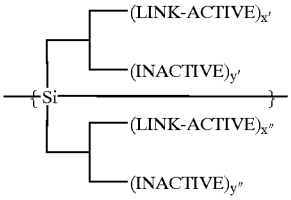

In addition, the electrolytic compositions of this invention can comprise a mixture of homopolymers or copolymers that are represented by Structures II and III:

II

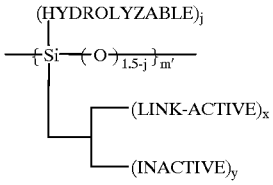

III

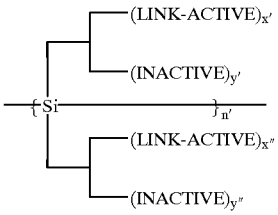

The components of all of these Structures are defined in more detail below.

Particularly useful silsesquioxanes can be illustrated by the following structure IV showing two types of copolymerized silyl units:

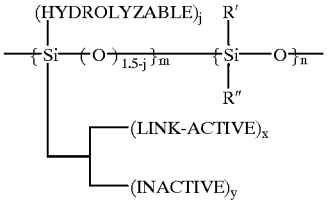

In the Structures noted above, "HYDROLYZABLE" represents hydroxy or a "hydrolyzable group" that is monovalent and that readily hydrolyzes under the conditions employed during preparation of the polymer. The HYDROLYZABLE groups in the polymer represent the individual groups that were not hydrolyzed during preparation because of steric constraints or other reasons. Generally, in the polymer useful in this invention, most of the HYDROLYZABLE groups are hydroxy groups. However, other HYDROLYZABLE groups can be present, including but not limited to, hydrogen, halo groups (such as iodide, bromide and chloride), alkoxy groups having from 1 to 6 carbons, substituted or unsubstituted alkylcarboxy groups wherein the alkyl portion has 1 to 6 carbon atoms (such as acetoxy and ethylcarboxy), and -(O-alkylene)$_p$-O-alkyl groups wherein the "alkylene" portion is a substituted or unsubstituted alkylene group having from 2 to 6 carbons, p is an integer from 1 to 3, and the "alkyl" portion is a substituted or unsubstituted alkyl group having from 1 to 6 carbons. Other useful HYDROLYZABLE groups include primary and secondary amino groups having from 1 to 6 carbon atoms, such as —N(alkyl)$_2$ wherein each alkyl group can independently have from 1 to 6 carbon atoms and —NH (alkyl) wherein the alkyl group can have from 1 to 6 carbon atoms. It is preferred that substantially all HYDROLYZABLE groups be hydroxy groups.

Some silicon atoms in the silyl groups could bear two or three "non-hydrolyzable" organic groups, or a small percentage of silicon atoms could be replaced by atoms of another metal, such as aluminum, or a small percentage of silicon atoms in those silyl groups could bear organic groups not within the scope of the definitions of LINK-ACTIVE and INACTIVE as defined herein.

The silsesquioxanes useful in this invention are relatively large oligomers or polymers. The total number of silyl units represented by both "m" and "n" in Structures I and IV (that is, the total number of silyl units) in random or block copolymer form should be at least 20. As the number of silyl units is increased, the silsesquioxane becomes, in effect, a very large single molecule. Like highly crosslinked polymers, there is theoretically no upper limit on the number of silyl units and the total number of silyl units can be a very large number. Preferably, the silsesquioxane polymers have at least 25 total silyl units distributed in the molar ratio defined by m and n. Similarly, each of m' and n' is at least 10, and preferably each is at least 20, provided that the relative weight percents of the silsesquioxane and polymer of Structures II and III are adjusted in the mixture as described below.

In Structure IV, R' and R" are independently substituted or unsubstituted alkyl groups having 1 to 10 carbon atoms (such as methyl, ethyl, propyl, isopropyl, t-butyl, chloromethyl, hexyl, benzyl and octyl), or a substituted or unsubstituted aryl group having from 6 to 10 carbon atoms in the carbocyclic ring (such as phenyl, m- or p-ethylphenyl, m- or p-methylphenyl and naphthyl). Thus, the R' and R" groups can be the same or different group. However, preferably, each of R' and R" is methyl, ethyl or phenyl. Most preferably, each is methyl.

Because both R' and R" are non-hydrolyzable groups (as "hydrolyzable" is defined above), the silyl units containing R' and R" are derived from silanes that have only two HYDROLYZABLE groups. One or more of such silanes can be used to prepare the silsesquioxanes useful in the practice of this invention.

In Structures I and IV, m can be from about 50 to 100 mole percent, preferably from about 50 to about 99 mole percent, and more preferably from about 75 to about 99 mole percent, based on the total silyl (—OSi—) units in the silsesquioxane. Correspondingly, n is from 0 to about 50 mole percent, preferably from about 1 to about 50 mole percent, and more preferably from about 1 to about 25 mole percent, based on the total silyl units. A skilled artisan would readily be able to use the appropriate amounts of the various types of silanes to obtain the desired molar ratios in the resulting silsesquioxane polymers to provide the desired properties. The most preferred silsesquioxanes are those wherein n is at least 1 mole percent, and preferably at least 10 mole percent (generally up to 50 mole percent and preferably up to 25 mole percent). The preparation and use such silsesquioxanes are described in copending and commonly assigned U.S. Ser. No. 09/223,429 filed by Ferrar, Yoerger, Cowdery, Sinicropi, Parton and Weiss (noted above).

The value of j in Structures I, II, and IV is less than or equal to 0.5 and greater than or equal to 0. Preferably, j is greater than or equal to 0 and less than or equal to 0.4. More preferably, it is from about 0.1 to about 0.4. The value of j corresponds to the mole percentage of $T^2$ silicon atoms relative to the total of $T^2+T^3$ silicon atoms. When j is from 0 to 0.5, it reflects a $T^3/T^2$ of from about 1:1 to about 0:1. A preferred ratio is from about 0.7:1 to about 0:1.

Also in the noted Structures, x+y, x'+y' and x"+y" are independently equal to about 1. The values of x and y (and similarly, x' and y' and x" and y"), that is, the relative molar concentrations of "active" units (silyl units bearing a -LINK-ACTIVE group) and "inactive" units (silyl units bearing an -INACTIVE group), can be varied to provide desired resistivity. In preferred embodiments of the invention, active units represent less than about 45 mole percent of the silyl units of the polymer. In other words, (x+x'+x")/(x+y+x'+y'+x"+y") is less than or equal to 0.45. In Structure IV, x/(x+y) is less than or equal to 0.45.

INACTIVE represents an aromatic or nonaromatic group having from 1 to 12 carbon atoms. INACTIVE groups are not capable of participation in a siloxane polycondensation reaction and do not transport charge. The following monovalent or divalent groups are examples of suitable INACTIVE groups: substituted or unsubstituted alkyl groups having from 1 to 12 carbons (including linear and branched alkyl groups, including benzyl groups), substituted or unsubstituted fluoroalkyl groups having from 1 to 12 carbons (including branched or linear alkyl groups), substituted or unsubstituted cycloalkyl groups having a single 5- or 6-membered carbocyclic ring (such as substituted and unsubstituted cyclopentyl and cyclohexyl groups), and substituted or unsubstituted aryl groups having a 6- to 10-membered carbocyclic ring (such as substituted or unsubstituted phenyl and naphthyl groups). Monovalent groups are bonded to the Si atom of a single silyl unit of the silsesquioxane. Divalent groups are bonded to the Si atoms of two silyl units. INACTIVE groups can all be the same or different throughout the polymer. Specific examples of monovalent INACTIVE groups include but are not limited to, methyl, ethyl, n-propyl, isopropyl, n-butyl, isobutyl, t-butyl, n-decyl, perfluorooctyl, cyclohexyl, phenyl, dimethylphenyl, benzyl, naphthyl and trimethylsiloxy groups. A representative divalent INACTIVE group is a 1,4- or 1,3-phenylene group that links two silyl units of the silsesquioxane.

LINK represents divalent groups corresponding to the monovalent groups described above for defining INACTIVE. For example, LINK can be a substituted or unsubstituted alkylene group having from 1 to 12 carbon atoms that can have arylene groups in the chain (such as methylene, ethylene, isopropylene or methylenephenylene), a substituted or unsubstituted fluoroalkylene group having from 1 to 12 carbon atoms (such as fluoromethylene and other groups similar to those used in the definition of alkylene), a substituted or unsubstituted cycloalkylene group having 5 to 10 carbon atoms in the ring (such as cyclohexylene), or a substituted or unsubstituted arylene group having 6 to 10 carbon atoms in the carbocyclic ring (such as phenylene) as described above.

ACTIVE is a group in the silsesquioxane polymer that is complexed with the charge carrier in the solid electrolyte layer. In preferred embodiments of the invention, ACTIVE is a monovalent organic group having from 4 to 20 carbon, nitrogen, oxygen or sulfur atoms in any suitable form (linear, branched, carbocylic or heterocyclic). Many ACTIVE groups contain at least one oxy, thio, ester, imino or amino groups. Suitable ACTIVE groups that complex with cations include neutral rings and chains of ethylene oxides, propylene oxides and tetramethylene oxides, ethylene imines, alkylene sulfides, glycidoxy ethers, epoxides, pyrolidinones, amino alcohols, amines, carboxylic acids and the conjugate salts, sulfonic acids and the conjugate salts. Suitable ACTIVE groups that complex anions include ammonium salts, phosphonium salts, sulfonium salts, and arsonium salts.

In at least some embodiments of the invention, the ACTIVE group is capable of participation in a siloxane polycondensation reaction as a catalyst. Examples of such groups are primary, secondary, tertiary and quaternary amines. The concentration of such catalytic active silyl units can be varied to provide a convenient reaction rate. In some preferred embodiments of the invention, from about 0.5 to about 30 mole percent of the silyl units in the polymer include any of the following active groups:

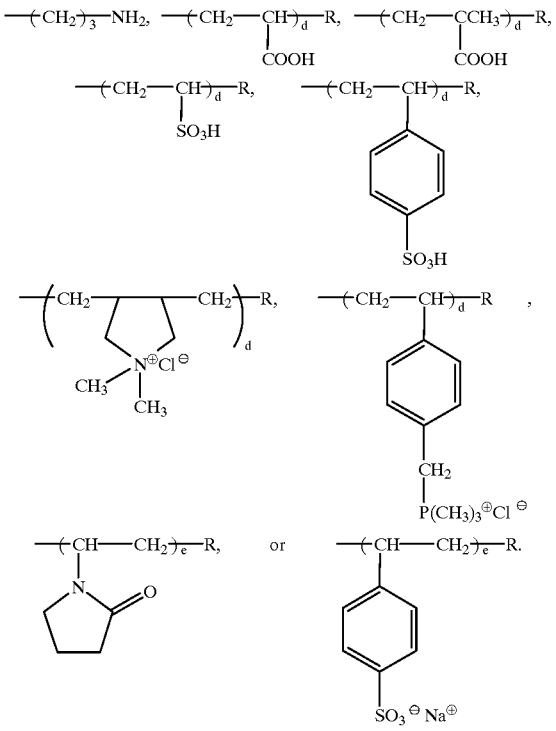

In the above groups, d and e are selected such that the total number of carbons in -LINK-ACTIVE is from 4 to 25.

The following groups are also specific examples of-ACTIVE groups:

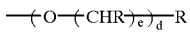

wherein e is from 2 to 5, and d is from 1 to 6,

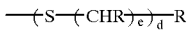

wherein e is from 2 to 5, and d is from 1 to 6,

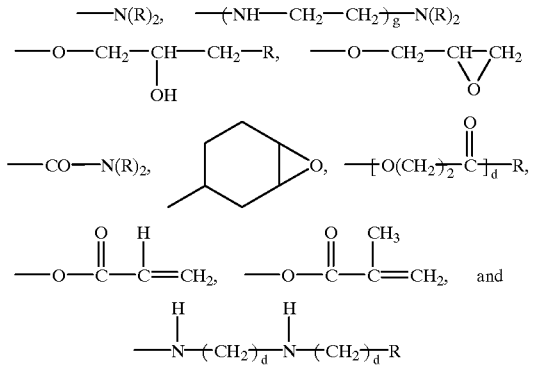

wherein d is from 1 to 6.

In these groups, unless otherwise indicated, R is hydrogen, a substituted or unsubstituted alkyl group, or a substituted or unsubstituted fluoroalkyl group, each having from 1 to 12 carbons (as defined above for other alkyl and fluoroalkyl groups), g is from 1 to 12, Ar is a substituted or unsubstituted aryl group having a single 6- to 10-membered carbocyclic ring (as described above for other aryl groups). R can also be a substituted or unsubstituted alkylcarboxy group (such as acetoxy and ethylcarboxy). The total number of carbons in -LINK-ACTIVE is from 4 to 25. Specific examples of some -LINK-ACTIVE groups include but are not limited to aminopropyl, dimethylaminopentyl, propylethylene diamine, propylethylene triamine, 3-glycidoxypropyl, 2-(3,4-epoxycyclohexyl)ethyl, 3-acryloxypropyl, 3-methacryloxypropyl, 3-isocyanatopropyl and N-[2-(vinylbenzylamino)ethyl]-3-aminopropyl. It is possible that the substituents of the ACTIVE groups may react with one another to further increase crosslinking in the polymer, such as by ring opening of an epoxide by an amine.

Some considerations apply to both the "active" and "inactive" silyl units of the silsesquioxane. The polymer can include a mixture of different "active" silyl units or a mixture of different "inactive" silyl units or mixtures of both. The -LINK-ACTIVE and INACTIVE groups should not be substantially hydrolyzed in the siloxane polycondensation reaction used to prepare the silsesquioxane polymer since the organic substituents would be lost and the resulting polymer would exhibit a very high degree of crosslinking. Moreover, the -LINK-ACTIVE and INACTIVE groups should not be so large as to cause steric problems. For example, a suitable maximum for the number of carbon and heteroatoms in a -LINK-ACTIVE group is 25 and for an INACTIVE group it is 12.

The charge carrier used in the solid electrolyte layer is selected based upon the selection of the ACTIVE groups in the silsesquioxane. The term "charge carrier" is used herein to describe a substance that complexes with the ACTIVE group to yield a mobile species or combination of species that carry charge within the solid electrolyte layer. The charge carrier can be a salt or mixture of salts. The mobile species is one or both ions of the salt or one or both ions of the various salts of the mixture. The charge carrier can also be or include a substance that, as an isolated material, is not a salt. An example of the latter type of charge carrier is the complexation product of molecular iodine. This type of charge carrier provides a mobile species that forms a donor-acceptor or charge-transfer complex with the ACTIVE group in which the resulting charge separation has substantial ionic character.

A wide variety of charge carriers can be used in the practice of this invention. Selection of a suitable charge carrier for a particular use is a matter of relatively simple trial and error. The charge carrier must be capable of forming a complex with the ACTIVE group such that the silsesquioxane-charge carrier complex is electrically conducting. In preferred embodiments of the invention, the charge carrier must be capable of forming a complex with the ACTIVE group such that the silsesquioxane-charge carrier complex is electrically conducting in the absence of moisture. For salts, this is commonly described as "dissolving in the matrix". An explanation of this "dissolving" is described in U.S. Pat. No. 5,731,117 (noted above).

Complex formation with a particular ACTIVE group can be determined by a variety of means. For example, Fish et al [*Makromol. Chem. Rapid Commun.* Vol. 7, (1986), pp. 115–120] teach that complex formation can be tracked by measuring the increase in glass transition temperature (Tg) as the amount of salt or other charge carrier in the polymer is increased. Care must be taken to account for changes in Tg due to curing during the analysis.

The charge carrier and ACTIVE group are selected to provide a particular electrical conductivity, and its inverse, resistivity, under conditions of low ambient relative humidity (except in embodiments where water provides the charge carrier). Particular ranges are desirable for solid electrolytes used for a number of different purposes. For example, a solid electrolyte layer used in an electrophotographic element has a desirable surface resistivity of at least $1\times10^{10}$ ohms/sq, or more desirably, a surface resistivity of at least $1\times10^{14}$ ohms/sq.

The charge carrier and ACTIVE group can also be selected so as to provide other characteristics desired in a particular embodiment of the invention. For example, the charge carrier used in a solid electrolyte layer of an electrophotographic element can be selected to provide particular tribocharging characteristics, both in terms of polarity and placement in a triboelectric series relative to toner and carrier materials.

For another example, the charge carrier and ACTIVE group can be selected such that "blooming" is eliminated or reduced. Ammonium salts can be used as charge carriers. However, these salts "bloom", that is, migrate to the surface of a solid electrolyte layer resulting in an enhanced degree of ammonium activity on the surface or in an upper layer. Ammonium salts are commonly used to cure silsesquioxanes. Blooming is a recognized shortcoming of that procedure. In electrophotography, blooming is undesirable since it may cause variability in electrophotographic properties, leading to problems such as image artifacts. A charge carrier can be selected that is non-blooming or resistant to migration. The "curing" or catalytic function that would otherwise be provided by the ammonium salts can be provided by selection of an ACTIVE group that is a siloxane polycondensation catalyst. The ACTIVE group is not mobile within the solid electrolyte layer and thus does not bloom.

The charge carrier can be an inorganic or organic alkali salt, one or both ions being mobile in the complex. Such suitable salts include, but are not limited to LiCl, $CH_3COOLi$, $LiNO_3$, $LiNO_2$, LiBr, $LiN_3$, $LiBH_4$, LiI, LiSCN, $LiClO_4$, $LiCF_3SO_3$, $LiBF_4$, $LiBPh_4$, NaBr, $NaN_3$, $NaBH_4$, NaI, NaSCN, $NaClO_4$, $NaCF_3SO_3$, $NaBF_4$, $NaBPh_4$, KSCN, $KCIO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$, $CsBPh_4$. "Ph" used herein represents a phenyl group (substituted or unsubstituted). These salts are highly resistant to blooming when used with the silsesquioxanes useful in the practice of this invention. Other suitable salts include quaternary ammonium salts, ammonium hydroxide and ammonium halides. These salts and the other salts previously listed can be used individually or in combination.

A suitable concentration of charge carrier in a silsesquioxane electrolytic coating composition or the resulting solid layer is from about 0.1 to 10 weight percent relative to the dry weight of the silsesquioxane. A currently preferred charge carrier is LiI, and a currently preferred concentration is from about 0.5 to 2 weight percent relative to the dry weight of the silsesquioxane.

In some embodiments of this invention, the silsesquioxane polymers can also have silyl units represented by the structures described in Columns 12–14 of U.S. Pat. No. 5,731,117 (noted above) as long as those silyl units are included among the silyl units present at "m" mole percent in Structures I and IV, and represented by Structure II. Further details of the structures in Cols. 12–14 will not be included here, but are incorporated herein by reference.

As noted above, another essential component of the overcoat is a tertiary arylamine (or mixture thereof) that is present to function as an acid scavenger. This compound is soluble in the overcoat as well as the solvent-based formulations used to prepare such layers. It is also designed so as to limit its diffusibility within or out of the overcoat. Diffusibility can be limited in a number of ways. For example, the acid scavenger molecule can be designed with one or more "bulky" groups (that is, groups having a molecular weight of at least 50) that keep the molecule within the solid silsesquioxane polymer matrix of the overcoat.

Alternatively, the acid scavenger can have functional groups that can be reacted to provide covalent linkage to the silsesquioxane polymer matrix. Such functional groups include, but are not limited to, hydroxy, oxycarbonylalkyl (such as acetoxy and propionoxy), isocyanato, epoxy, amino (primary or secondary) and silicon ester groups, that are located in a suitable place in the acid scavenger molecule as would be apparent to a skilled worker using the teaching of representative molecules provided below. These reactive functional groups can be used to react the acid scavenger to any suitable portion of the silsesquioxane polymer matrix, as would be readily apparent to a skilled artisan.

Other means for limiting diffusibility would be readily apparent to one skilled in the art.

The compounds used as acid scavengers in this invention are also "basic" in nature and thus generally have a pKa of at least 4 in water. Preferably, the pKa is from about 4 to about 10, and more preferably it is from about 4 to about 8.

The acid scavenger (or mixture thereof) is present in the overcoat in an amount of at least 0.2 weight %, preferably in an amount of from about 0.5 to about 50 weight %, and more preferably in an amount of from about 1 to about 30 weight %. These weight percentages are based on the total overcoat dry weight.

Representative acid scavengers are tertiary arylamines that can be described with Structure V:

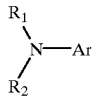

wherein $R_1$ and $R_2$ are independently substituted or unsubstituted hydrocarbon groups, other than aryl groups, having from 1 to 12 carbon atoms, and Ar is a substituted or unsubstituted carbocyclic aromatic group. Preferably, Ar is substituted as described in more detail below.

Still further, the acid scavengers can be represented by Structure VI:

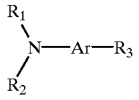

wherein $R_1$, $R_2$ and Ar are as defined above for Structure V, and $R_3$ is hydrogen, halo, or a substituted or unsubstituted organic group.

More particularly, $R_1$ and $R_2$ are independently substituted or unsubstituted alkyl groups having 1 to 12 carbon atoms (such as methyl, ethyl, n-propyl, isopropyl, t-butyl, hexyl, benzyl, hydroxymethyl, 2-hydroxyethyl, 2-aminoethyl, and 2-mercaptoethyl), substituted or unsubstituted cycloalkyl groups having 5 to 6 carbon atoms in ring systems having one or more rings (such as cyclopentyl, cyclohexyl, 4-hydroxycyclohexyl and $^4$-aminocyclohexyl), substituted or unsubstituted alkenyl groups having 2 to 10 carbon atoms (such as ethenyl, 1,2-propenyl, geranylamine, geranyl chloride and geranyl bromide), or substituted or unsubstituted alkynyl groups having 2 to 10 carbon atoms (such as ethynyl, 1,2-propynyl, 5-hexynenitrile and 3-hexyn-1-ol). $R_1$ and $R_2$ can also be a hydrocarbon group having a combination of alkyl, alkenyl, alkynyl and cycloalkyl groups as defined above. Neither $R_1$ nor $R_2$ is a carbocyclic aryl group.

In addition, $R_1$ and $R_2$ together can represent the carbon, oxygen, nitrogen and sulfur atoms necessary to complete a 3- to 10-membered ring with the nitrogen atom in either structure V or VI. Such rings can be saturated or unsaturated.

Preferably, $R_1$ and $R_2$ are independently a substituted or unsubstituted alkyl groups each having 1 to 4 carbon atoms, and more preferably, each of them is a substituted or unsubstituted alkyl group having 1 to 3 carbon atoms. Most preferred alkyl groups are substituted or unsubstituted methyl, ethyl and n-propyl groups. It is also preferred that at least one of $R_1$ and $R_2$ be substituted with at least one hydroxy, alkylcarboxy, isocyanato, epoxy, amino or silicon ester functional group as described above (more preferably, a hydroxy group).

In Structure V and Structure IV identified above, Ar is a carbocyclic aryl group that can have one or more substituents as defined herein. Preferably, Ar has only one substituent as defined in more detail below. Generally, Ar is phenyl, naphthyl or anthryl that can have one or more substituents. Ar can also include one or more solubilizing groups as defined above, but such functional groups must be connected to Ar through a nonaromatic hydrocarbon group (such as an alkyl group having 1 to 4 carbon atoms as defined above for $R_1$ and $R_2$), or a secondary or tertiary amine (such as mono- or dialkylamino group wherein each alkyl portion has 1 to 4 carbon atoms). Preferably, any such functional group that is connected to Ar is a hydroxy group. The more preferred Ar groups are substituted or unsubstituted phenyl groups.

The $R_3$ group in Structure VI can be hydrogen, halo (such as chloro, bromo or fluoro), or a substituted or unsubstituted organic group that has a molecular weight of at least 50 and can include one or more carbocyclic aryl groups, cycloalkyl groups, alkyl groups, alkenyl groups, alkynyl groups, aromatic or nonaromatic heterocyclic groups, or combination of any these (such as a carbon atom substituted with an alkyldiaryl group, a dialkylaryl group or a trialkyl group). Particularly useful $R_3$ groups include triarylmethyl groups (such as triphenylmethyl, tritolylmethyl and tolyldiphenylmethyl). It is also possible that the $R_3$ group can include one or more hydroxy, alkylcarboxyl, isocyanato, epoxy, amino or silicon ester functional groups as identified above, and preferably such groups are connected to $R_3$ (where for example, $R_3$ is a triarylmethyl group) through a mono- or dialkylamino group (as defined above for Ar), or through a hydrocarbon linkage having 1 to 12 carbon atoms. Hydroxy is a most preferred functional group in this context. A wide variety of useful $R_3$ groups could be designed by a skilled worker in the art to accomplish the desired purposes.

Several representative acid scavengers are identified below by structure. Acid Scavenger I is most preferred in the practice of this invention.

ACID SCAVENGER I

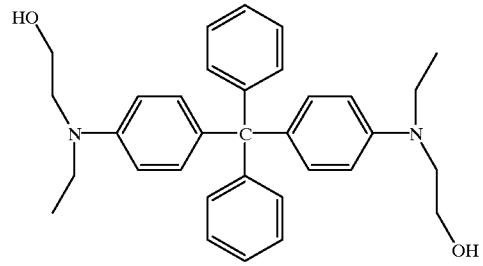

ACID SCAVENGER II

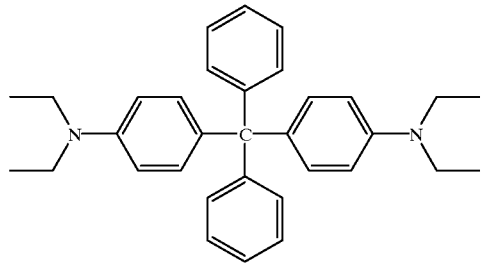

ACID SCAVENGER III

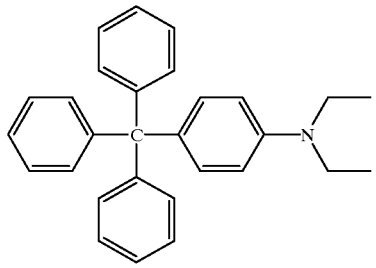

ACID SCAVENGER IV

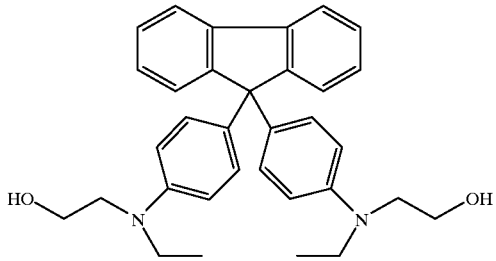

ACID SCAVENGER V

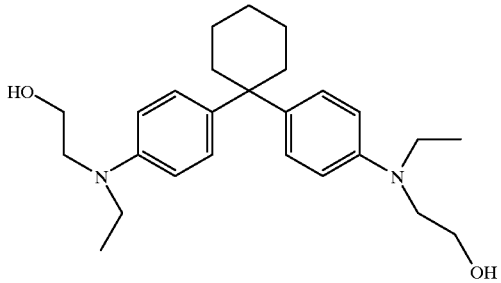

ACID SCAVENGER VI

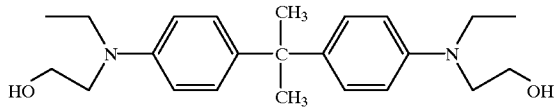

-continued

ACID SCAVENGER VII

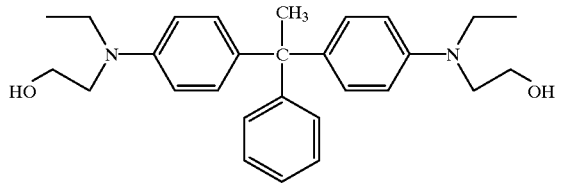

ACID SCAVENGER VIII

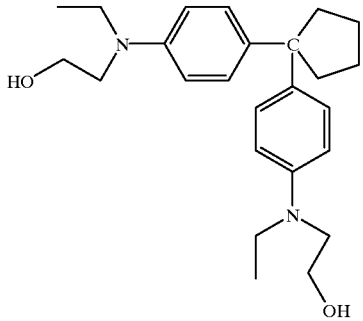

The solid electrolyte layer used in the invention can include a wide variety of addenda such as fillers including metal oxide particles and beads of organic polymers. Fillers can be added to modify some of the properties of the resulting solid electrolyte layer. For example, metal oxide particles could be added to increase abrasion resistance, and fluorocarbon polymer beads could be added to reduce frictional loads on the surface. Filler is added in a concentration that is small enough to not cause deleterious changes in the physical properties of the solid electrolyte layer. Some fillers can be covalently bonded into the overall matrix of the silsesquioxane. An example of such a filler material is colloidal hydrophilic silica, such as basic LUDOX silica available from DuPont. The solid electrolyte layer may also include one or more surfactants such as fluorosurfactants that provide surface lubricity and protection.

In some embodiments of the invention, the solid electrolyte layer can include what is referred to herein as a "secondary active agent". The secondary active agent is a non-silsesquioxane compound that includes one or more ACTIVE groups, as those groups are defined above for the silsesquioxane polymer. In a particular solid electrolyte layer, the ACTIVE groups of the secondary active agent can be the same or different than those of the silsesquioxane polymer. A single secondary active agent or a number of different secondary active agents can be present in the solid electrolyte layer. The secondary active agent may or may not be involved in charge transport. If the secondary active agent is involved, the additional charge transport provided increases conductivity less than about 5 or 10%. The secondary active agent can provide additional functions such as a plasticizing or lubricating function.

In addition, the solid electrolyte layer can include an alcohol-soluble surfactant. Suitable classes of surfactants include siloxane-alkylene oxide copolymers available from Dow Corning and OSi Specialties (formerly Union Carbide). These materials act as plasticizers and lubricants and are also secondary active agents. Also useful are cationic surfactants such as FC135 fluorosurfactant (available from 3M Corp.) that contains a tetraalkylammonium iodide as the cationic group. This material can also be a charge carrier with iodide ions as the mobile species, and includes tetraalkylammonium ACTIVE groups. Also useful are anionic surfactants, such as those sold under the trademarks TRITON, AEROSOL and ALIPAL. These surfactants contain sodium salt groups which can act as charge carriers, that is, the sodium salt groups can ionize in the solid electrolyte to provide low lattice energy salts as mobile species. Also useful is the ZONYL FSN surfactant from DuPont that contains ethylene oxide ACTIVE groups and iodide salts.

In another embodiment of the invention, the surfactant is a poly(alkylene oxide)-co-poly(dimethylsiloxane) as described in U.S. Pat. No. 5,731,117 (noted above). A specific example of such surfactants is commercially available as SILWET Surface Active Copolymers from OSi Specialties, Inc. (such as SILWET L-7002 surfactant).

In some embodiments of the invention, the solid electrolyte layer can include a plasticizer that is incorporated into the silsesquioxane polymer matrix. Examples of classes of suitable plasticizers include alkyltris(polysiloxane polyether copolymers)silanes, that are similar in structure to the surfactants noted above, but are bulkier and tend to stay in the silsesquioxane polymer matrix to a greater degree. Examples of suitable alkyltris(polysiloxane polyether copolymers)silanes are the polysiloxane polyether copolymers described in U.S. Pat. No. 4,227,287 (Frye). Such materials are available commercially from OSi Specialties under the designation L-540 and from Dow Coming Corporation under the designation DC-190. Suitable concentrations are from about 0.5 to 6 parts by weight based on the dry weight of the silsesquioxane. Another useful plasticizer or lubricant is trimethylsiloxyl terminated poly (dimethylsiloxane) having a molecular weight of less than about 5,000 and preferably having a molecular weight from about 300 to about 3000.

Other plasticizers that would remain free to migrate within the silsesquioxane polymer are not preferred, but can be added in amounts small enough to not unacceptably degrade the physical and electrical properties of the resulting element. Such plasticizers include nylons such as ELVAMIDE 9061 and ELVAMIDE 8064 (available from DuPont).

The solid electrolyte layer used in this invention is prepared in a manner similar to the preparation of a silsesquioxane noted in U.S. Pat. No. 5,731,117 (noted above). The polymers can be formed at moderate temperatures by a type of procedure commonly referred to as a "sol-gel" process. In this process, the appropriate silicon alkoxides (or other polymerizable compounds to provide the desired silyl units) are hydrolyzed in an appropriate solvent medium, forming the "sol". Then the solvent medium is removed resulting in a condensation and the formation of a crosslinked gel. A variety of solvents can be used. Water, lower alcohols (such as methanol, ethanol, and isopropanol) and mixtures thereof (such as aqueous methanolic or ethanolic solutions) are generally preferred. Aqueous-alcohol solvent mixtures are most preferred as the solvent medium. The silsesquioxanes are conveniently coated from acidic alcohols, since the silicic acid form $RSi(OH)_3$ can be stable in solution for months at ambient conditions. The charge carrier is then added in an appropriate concentration along with any addenda prior to the polycondensation reaction. The extent of condensation is related to the amount of curing a polymer sample receives, with temperature and time being among the two most important variables.

In the preparation of the solid electrolyte layer used in the invention, the reactive silicon precursor compounds (silanes) that include -LINK-ACTIVE and INACTIVE groups in the proportions desired in the resulting silsesquioxanes include, but are not limited to: methyltrimethoxysilane, methyltriethoxysilane, n-propyltrimethoxysilane, n-propyltriethoxysilane, (3,3,3-trifluoropropyl)trimethoxysilane, methyltriacetoxysilane, (heptadecafluoro-1,1,2,2-tetrahydrodecyl)triethoxysilane, 3-aminopropyltrimethoxysilane, 3-aminopropyltriethoxysilane, 3-aminopropylmethyldiethoxysilane, 3-aminopropyldimethylethoxysilane, 3-aminopropyldiisopropylethoxysilane, 3-aminopropyltris-(methoxyethoxyethoxy)silane, 3-(1-aminopropoxy)-3,3-dimethyl-1-propyltrimethoxysilane, N-(6-aminohexyl) aminopropyltrimethoxysilane, N-2-(aminoethyl)-3-aminopropyltris(2-ethylhexoxy)silane, N-(2-aminoethyl)-3-aminopropyltrimethoxysilane, N-(2-aminoethyl)-3-aminopropylmethyldimethoxysilane, (aminoethylaninomethyl)-phenethyltrimethoxysilane, 4-aminobutyltriethoxysilane, (N,N-dimethyl-3-aminopropyl)trimethoxysilane, N-methylaminopropyltrimethoxysilane, N-[(3-trimethylsilyl)propyl]-ethylenediamine triacetic acid trisodium salt, N-trimethoxysilylpropyl-N,N,N-trimethylammonium chloride, N-trimethoxysilylpropyltri-N-butylammonium bromide, 2-(3,4-epoxycyclohexyl)ethyltrimethoxysilane, 3-isocyanatopropyltriethoxysilane, 3-isocyanatopropyldimethylchlorosilane, 5,6-epoxyhexyltriethoxysilane, (3-glycidoxypropyl) trimethoxysilane, acetoxymethyltrimethoxysilane, acetoxypropyltrimethoxysilane, (3-glycidoxypropyl) methyldiethoxysilane and (3-glycidoxypropyl) methyldimethoxysilane.

Silane reactants having only two HYDROLYZABLE groups as defined above include but are not limited to, dimethyldimethoxysilane, diethyldimethoxysilane, diisopropyldimethoxysilane, diphenyldimethoxysilane, dimethyldiethoxysilane, diethyldiethoxysilane, diphenyldiethoxysilane and 1,7-dichlorooctamethyltetrasiloxane. Dimethyldimethoxysilane is a most preferred silane reactant of this type.

An optional but preferred layer of the elements of this invention is a primer or adhesive layer between the charge generating layer and the solid electrolyte layers. The primer layer is selected so as to provide a good mechanical bond between the two layers, but not to interfere with charge related properties. The dry thickness of the primer layer is generally from about 0.1 to about 1.0 $\mu$m and is preferably up to 0.5 $\mu$m. It is important that neither the primer, nor the solvent that the primer is coated from, damage the photoconductor layers.

In addition, the primer layer should have a surface resistivity of at least $10^{10}$ ohms/square, and preferably of at least $10^{14}$ ohms/square.

Suitable coating solvents include water, lower alcohols (methanol, ethanol and isopropanol), and other water-miscible, polar organic solvents (such as ethyl acetate, acetone and 2-propanone), and mixtures thereof. The aqueous alcoholic solvent mixtures are preferred, and an aqueous methanolic mixture or an alcohol/ethyl acetate mixture is most preferred.

Suitable primers include one or more polymers as would be readily known in the art, including those described in U.S. Pat. No. 5,731,117 (noted above). Particularly useful polymers for primer layers are addition polymers that are either soluble or form emulsions in these solvents. In addition, the primer polymer (or mixtures thereof) should have a glass transition temperature of at least 25° C., and preferably of from about 30 to about 170° C. Glass transition temperature for polymers is a conventional parameter that can be measured using known procedures and instrumentation. By "addition" polymer is meant a homopolymer or copolymer prepared by polymerizing one or more olefinically unsaturated polymerizable monomers using any suitable polymerization technique. Thus, "addition" polymer does not mean that the polymer must be prepared only by what are known in the art as "addition polymerization" techniques.

Examples of suitable primer polymers include, but are not limited to, acrylics, pyrrolidones and styrenics. The acrylics are most preferred. The polymers are generally prepared by polymerizing one or more olefinically unsaturated polymerizable monomers in an appropriate reaction medium using conventional procedures, conditions and catalysts. For example, some of the useful monomers include but are not limited to, methyl acrylate, ethyl acrylate, methyl methacrylate, ethyl methacrylate, hydroxymethyl acrylate, acrylic acid, methacrylic acid, itaconic acid, styrene, vinyl toluene, acrylonitrile, isobutyl methacrylate, and so many others that would be readily apparent to one skilled in the art. The methyl and ethyl acrylates and methacrylates are preferred.

The useful primer polymers can be homopolymers prepared from individual monomers. Preferably, however, they are copolymers prepared from two or more of such monomers in proportions that provide the desired characteristics noted above (coatability from coating solvents, glass transition temperature and conductivity of coated layer). For example, copolymers prepared from methyl acrylate and methyl methacrylate are desirable. A skilled artisan could carry out routine experimentation to determine the various copolymers and monomer ratios that would be useful.

Some particularly useful primer polymers are various poly(methyl acrylate-co-methyl methacrylate-co-methacrylic acid)s in various monomer weight ratios. The most preferred weight ratio of the three polymerizable monomers is 70/25/5 weight ratio. The synthesis of this particular polymer is described in U.S. Pat. No. 5,731,117 (noted above), but other vinyl polymers could be similarly prepared. Another example of a specific primer polymer is poly(vinyl pyrrolidone-methacrylic acid) (95/5 weight ratio).

In addition, preferred primer layers are composed of a composition comprising one or more addition polymers as described above [particularly poly(methyl acrylate-co-methyl methacrylate-co-methacrylic acid) as described above], and contains substantially no "free" compounds (including nonionic surfactants) that include ACTIVE groups as defined herein. By "free" we mean that while the primer layer may include ACTIVE groups that are covalently attached to the primer polymer(s) in some manner, the primer layer contains substantially no other compounds in admixture with the primer polymers that would include such ACTIVE groups in either ionic or covalent form. By "substantially no" is meant that the primer layer contains compounds having ACTIVE groups at a concentration that is less than 0.1 weight % based on dry layer weight. When ACTIVE groups are bound to the primer polymer(s), they can be present in an amount of up to 10 weight % based on the dry polymer(s) weight.

Specifically, the preferred primer layers do not include any compounds such as surfactants that include oxyalkylene groups as would be in the case in certain TRITON nonionic surfactants (such as ethyleneoxy groups in TRITON X-100 nonionic surfactant) or acrylic acid groups.

All of the electrophotographic elements of the invention have multiple layers, since each element has at least an electrically conductive layer and one photoconductive (charge generating) layer, that is a layer that includes a charge generation material, in addition to a primer layer and a solid electrolyte overcoat layer.

The electrophotographic elements of the invention can be of various types including both those commonly referred to as single layer or single-active-layer elements and those commonly referred to as multiactive, or multiple--active-layer elements.

Single-active-layer elements are so named because they contain only one layer, referred to as the photoconductor or photoconductor charge generating layer, that is active both to generate and to transport charges in response to exposure to actinic radiation. Such elements have an additional electrically conductive layer in electrical contact with the photoconductor charge generating layer. In single-active-layer elements of the invention, the photoconductor charge generating layer contains charge-generation material to generate electron/hole pairs in response to actinic radiation and a charge-transport material, that is capable of accepting electrons or holes generated by the charge-generation material and transporting them through the layer to effect discharge of the initially uniform electrostatic potential. The charge-transport agent and charge generation material are dispersed as uniformly as possible in the photoconductor charge generating layer. This layer also contains an electrically insulative polymeric film-forming binder. The layer is electrically insulative except when exposed to actinic radiation.

Multiple-active-layer elements are so named because they contain at least two active layers, at least one of which is capable of generating charge, that is, electron/hole pairs, in response to exposure to actinic radiation and is therefore referred to as a charge-generation layer (CGL), and at least one of which is capable of accepting and transporting charges generated by the charge-generation layer and is therefore referred to as a charge-transport layer (CTL). In the invention, multiple-active-layer elements have an electrically conductive layer, a CGL, a CTL, and a solid electrolyte layer. Either the CGL or the CTL is in electrical contact with both the electrically conductive layer and the remaining CTL or CGL. The CGL contains charge-generation material and a polymeric binder. The CTL contains a charge-transport agent and a polymeric binder.

Single-active-layer and multiple-active-layer electrophotographic elements and their preparation and use in general, are well known and are described in more detail, for example, in U.S. Pat. No. 4,701,396, U.S. Pat. No. 4,666,802, U.S. Pat. No. 4,578,334, U.S. Pat. No. 4,719,163, U.S. Pat. No. 4,175,960, U.S. Pat. No. 4,514,481 and U.S. Pat. No. 3,615,414, the disclosures of which are incorporated herein by reference.

In preparing the electrophotographic elements of the invention, the components of the photoconductor charge generating layer, including binder and any desired addenda, are dissolved or dispersed together in a liquid to form an electrophotographic coating composition which is then coated over an appropriate underlayer, for example, a support or electrically conductive layer. The liquid is then allowed or caused to evaporate from the mixture to form the permanent photoconductive layer or CGL.

The polymeric binders used in the preparation of the coating compositions can be any of the many different binders that are useful in the preparation of electrophotographic layers, and are described in considerable detail in U.S. Pat. No. 5,731,117 (noted above). The polymeric binder is a film-forming polymer having a fairly high dielectric strength. In preferred embodiments of the invention, the polymeric binders also have good electrically insulating properties.

Suitable organic solvents for forming the polymeric binder solution can be selected from a wide variety of organic solvents, and are also described in U.S. Pat. No. 5,731,117 (noted above).

In the coating compositions for the CGL or photoconductor layer, the optimum ratios of charge generation material or of both charge generation material and charge transport agent, to binder can vary widely, depending on the particular materials employed. In general, useful results are obtained when the total concentration of both charge generation material and charge transport material in a layer is within the range of from about 20 to about 90 weight percent, based on the dry weight of the layer. In a preferred embodiment of a single active layer electrophotographic element of the invention, the coating composition contains from about 10 to about 70 weight percent of a charge-generation material and from 10 to about 90 weight percent of charge transport material.

Polymeric binders, charge transport materials and concentrations useful for the CGL or photoconductor layer are also useful for a CTL. The CTL can be solvent coated in the same manner as the charge generating layer. The coating composition can use the same solvents as in the charge generating layer. A similar process of preparing and then coating an appropriate coating composition can be followed for charge transport layers.

Any charge generation and transport materials can be utilized in elements of the invention. Such materials include inorganic and organic (including monomeric organic, metallo-organic and polymeric organic) materials; for example, zinc oxide, lead oxide, selenium, phthalocyanine, perylene, arylamine, polyarylalkane, and polycarbazole materials, among many others.

Various electrically conductive layers or supports can be employed in electrophotographic elements of the invention, for example, paper (at a relative humidity above 20%) aluminum-paper laminates, metal foils (such as aluminum foil and zinc foil), metal plates (such as aluminum, copper, zinc, brass and galvanized plates), vapor deposited metal layers (such as silver, chromium, vanadium, gold, nickel and aluminum), and semiconductive layers (such as cuprous iodide and indium tin oxide). The metal or semiconductive layers can be coated on paper or conventional photographic film bases such as poly(ethylene terephthalate), cellulose acetate, polystyrene, etc. Such conducting materials as chromium, nickel can be vacuum-deposited on transparent film supports in sufficiently thin layers to allow electrophotographic elements so prepared to be exposed from either side.

Electrophotographic elements of the invention can include various additional layers known to be useful in electrophotographic elements in general, for example, subbing layers, barrier layers (for example, charge blocking layers) and screening layers.

The electrophotographic charge generating elements of this invention can be imaged using an appropriate imaging source to generate a charged image pattern on the surface thereof. Appropriately charged toner developer can then be applied to provide a developed or deposited toned image on the element. The methods and materials for imaging and developing the elements would be readily apparent to a skilled artisan from the considerable literature relating to this field of technology.

The following synthetic methods are provided as illustrating methods of preparing silsesquioxane polymers, acid scavengers, overcoat formulations and vinyl primer polymers useful in the elements of this invention.

Synthesis of Acid Scavenger I

A mixture of 2-(N-ethylanilino)ethanol (600 g) and acetic anhydride (644 ml) was heated to about 90° C., at which point an exothermic reaction occurred and the temperature increased to about 140° C. After cooling to ambient temperature, the reaction mixture was diluted with 50° C. water, stirred for 5 hours, cooled and extracted with dichloromethane (DCM). The DCM fraction was mixed with more water and neutralized with dilute sodium bicarbonate solution. The DCM fraction was then washed three more times with water, and concentrated under vacuum to 756 g of crude 2-(N-ethylanilino)ethyl acetate, which was used without purification.

Crude 2-(N-ethylanilino)ethyl acetate (346 g), acetic acid (79 ml), toluene (119 ml) and dichlorodiphenylmethane (100 g) were combined and left standing in a closed flask for 7 days. The reaction mixture was concentrated under vacuum, taken up in 3 to 4 volumes of ethanol, treated with an excess of sodium hydroxide, refluxed for an hour, acidified to pH 4–5 by addition of concentrated hydrochloric acid, and extracted with DCM. The DCM extract was washed with water, dried with magnesium sulfate, filtered, concentrated, and passed through a short column of silica gel, eluting with DCM. Recrystallization from toluene and from acetone yielded 36 (34%) of bis[N-ethyl-N-(2-hydroxyethyl)anilino] diphenylmethane (I) as a white crystalline solid.

Synthesis of Acid Scavenger II

A mixture of N,N-diethylaniline (29.8 g) and dichlorodiphenylmethane (11.2 g)in acetonitrile (100 ml) was heated three days at 45° C., concentrated under vacuum, and partitioned between toluene and water. The toluene layer was concentrated under vacuum and recrystallized from methanol to afford bis[N,N-diethylanilino] diphenylmethane.

Synthesis of Acid Scavenger IV

A mixture of 2-(N-ethylanilino)ethanol (198 g), 9-fluorenone (218 g), and 1-propanol (150 ml) was warmed to dissolve the fluorenone, treated with concentrated hydrochloric acid (90 ml) and heated to reflux. After refluxing for two weeks, the cooled reaction mixture was mixed with 1 liter each of DCM and water, then treated with m ore concentrated HCl (40 ml) to lower the pH to ≦1. The DCM layer contained the excess 9-fluorenone, which could be recovered. The acidic water layer was mixed with another liter of DCM, then treated with 50% aqueous sodium hydroxide solution (100 mL) to raise the pH to ≧14. The DCM layer was separated and concentrated under vacuum to a crystallizing oil. The crude material was recrystallized from methanol to give 239 g (81%) of 9,9-bis[N-ethyl-N-(2-hydroxyethyl)anilino]fluorene (IV) as a white crystalline solid.

Synthesis of Acid Scavenger V

The method used to prepare Acid Scavenger IV (noted above) was used with 2-(N-ethylanilino)ethanol (112 g), cyclohexanone (72.6 g), ethanol (100 mL), and concentrated HCl (32 ml) to synthesize 73.1 g (52%) of 1,1-bis[N-ethyl-N-(2-hydroxyethyl)anilino]cyclohexane (V) as a white crystalline solid.

Preparation of Silsesquioxane Polymer A Formulation (2 weight % Acid Scavenger I)

All chemicals were purchased from Aldrich Chemical Company, except for DMS-E12 Epoxypropoxypropyl Terminated PolyDimethylsiloxane (molecular weight 900–1100) that was purchased from Gelest (Tullytown, Pa.). The acid scavenger bis[N-ethyl-N-(2-hydroxyethyl)aniline] diphenylmethane (Acid Scavenger I) was prepared as described above.

A 1-liter sol-gel formulation was prepared in a two liter round bottom flask as follows:

Glacial acetic acid (54.0 grams, 0.9 mol) was added dropwise to a previously prepared, stirred mixture of DMS-E12 (2.0 g), methyltrimethoxysilane (275.4 g, 2.02 mol), 3-glycidoxypropyltrimethoxysilane (30.6 grams, 0.130 mol), and dimethoxydimethylsilane (20 g, 0.166 mol) and the reaction mixture was stirred overnight. The acidified silanes were then hydrolyzed by the dropwise addition of water (156 grams, 8.67 mol) and the reaction mixture was stirred overnight. It was then diluted to approximately 20 weight % solids by the dropwise addition of ethanol (523 grams). The clear solution was stirred for one week, and dimethyldimethoxysilane (20 g, 0.166 mol ) was added followed by stirring for two or more weeks. The acid scavenger (4.0 g, 8.1 mmol) and lithium iodide (1.5 g, 11.2 mmol) were added and the solution filtered through a 0.4 $\mu$m glass filter and stored at 4° C.

Preparation of Acrylic Primer Polymer Latex

The preparation of a preferred acrylic primer polymer latex was carried out as follows:

To a 2 liter three-neck round bottom flask fitted with a mechanical stirrer, condenser and a nitrogen inlet was added 400 ml of deionized water, 20 ml of a 10% weight/volume solution of sodium dodecylsulfate, 1 gram of sodium persulfate and 0.5 grams of sodium bisulfite while the reaction flask was stirred in a 72° C. water bath. An addition funnel containing 70 grams of methyl acrylate, 25 grams of methyl methacrylate and 5 grams of methacrylic acid was placed on the stirred flask and the monomers were added over a 2 hour period. The aqueous phase and the organic phase were purged with nitrogen prior to the monomer addition. The reaction mixture was initially a pale blue color and then became a translucent whitish-blue color. The reaction was allowed to stir overnight, the addition funnel was removed to vent unreacted monomers under a positive nitrogen flow for 50 minutes, and the reaction flask was removed from the water bath and cooled with tap water. The polymer latex was purified by dialysis against water for 3 days. A small portion of the latex sample was isolated for analysis by freeze drying to give a white solid. The resulting polymer had a $T_g$ of 35° C. (midpoint). Elemental Analysis for methyl acrylate/methyl methacrylate/methacrylic acid ratios of $69/25/6_{wt}$: Found (Calc.) C 56.63 (56.84) H 7.32 (7.28).

EXAMPLE 1

Electrophotographic elements were prepared by coating a primer layer solution [as described above, 4% solid in methanol/water (1:1 weight)] onto the surface of a photoreceptor (photoconductor layer) at a web speed of about 6 m/min and a dryer temperature of 27° C. The resulting dry thickness of this layer was about 0.25 $\mu$m.

An overcoat formulation containing the Silsesquioxane Polymer A and Acid Scavenger I as described above was then coated onto this primer layer in a separate pass at a web speed of 3 m/min and using a drying profile of 104.5° C., 104.5° C., 82° C., 71° C. and 27° C. from the first to fifth dryers respectively. The resulting web was subsequently cut into sheets and cured at 82° C. for 24 hours. The cure of the resulting solid electrolyte layer was determined by Solid State $^{29}$Si NMR spectra obtained using a Chemagnetics CMX-300 Solid State NMR Spectrometer operating at 59.5607 MHz on samples scraped off the coatings with a razor blade.

EXAMPLE 2

Another element of this invention was prepared similarly to that in Example 1 except that 10 weight % of Acid Scavenger I (20.0 g, 40.6 mmol) was added to the ethanol solution during preparation o f the silsesquioxane overcoat formulation.

EXAMPLE 3

A silsesquioxane overcoat formulation was prepared similar to that used in Example 1 except that 10 weight % of Acid Scavenger IV (20.0 g, 40.4 mmol) was added to the ethanol solution during, preparation of the silsesquioxane overcoat formulation. An element was prepared using this overcoat formulation in a manner similar to that described in Example 1.

EXAMPLE 4

A silsesquioxane E overcoat formulation and element were prepared similar to that described in Example 1 except 10 weight % of Acid Scavenger V (20.0 g, 48.7 mmol) was added to the ethanol solution during preparation of the silsesquioxane overcoat formulation.

EXAMPLE 5

The corona resistance of the elements of this invention and comparative elements was observed by comparing the image width after 10 minutes of an image that was originally 3 mm wide, as shown in TABLE I below. "Image width" is an indication of lateral image spread. The image width was measured after the films were exposed to 2 minutes of negative corona while at high humidity (approximately 75% RH). It was observed that hi-her levels of acid scavenger ("AS") in the silsesquioxane overcoat reduced lateral image spread even more. The overcoat layers in the invention elements were 2 $\mu$m in thickness. The samples containing no Acid Scavenger I are the negatively-charging photoreceptors that did not have a silsesquioxane overcoat.

TABLE I

| | Image Width (mm) | | | | | |
|---|---|---|---|---|---|---|
| Time (min) | 2% AS I High RH | 2% AS I, High RH, 2 min corona | 10% AS I, High RH | 10% AS I, High RH, 2 min corona | 0% AS I, High RH | 0% AS I, High RH, 2 min corona |
| 10 | 3.04 | 4.04 | 3.01 | 3.23 | 3.08 | 4.56 |

EXAMPLE 6

The crystalline solid of Acid Scavenger I was rubbed on the surface of a negatively charging photoreceptor that did not have a silsesquioxane salt overcoat. TABLE II below shows the image width on the surface of the photoreceptor. Image width was negligible at ambient relative humidity and was unaffected by exposure to corona. However, the image width increased at high humidity with the acid scavenger on the surface, and 2 minutes exposure to negative corona increased the image width. It is therefore surprising that the incorporation of Acid Scavenger I into the silsesquioxane overcoat improves the corona resistance of the element as shown in TABLE I because merely putting it on the photoreceptor surface does not reduce image spread caused by exposure to corona.

TABLE II

| | PC rubbed with Acid Scavenger I | | | |
|---|---|---|---|---|
| | Image Width (mm) | | | |
| Time (min) | 41% RH | 38% RH, 2 min corona | 78% RH | 73% RH, 2 min corona |
| 10 | 3.16 | 3.22 | 4.47 | 8.03 |

EXAMPLE 7

The image width measurements for the elements having overcoats containing Acid Scavengers IV and V ("AS") are shown in TABLE III. Acid Scavenger IV showed similar behavior as Acid Scavenger I. However, Acid Scavenger V did not perform as well as the other two acid scavengers. The silsesquioxane overcoats in each element were 1 $\mu$m in thickness.

TABLE III

| | Image Width (mm) | | | | | |
|---|---|---|---|---|---|---|
| Time (min) | AS I, High RH | AS I, High RH, 2 min corona | AS IV, High RH | AS IV, High RH, 2 min corona | AS V, High RH | AS V, High RH, 2 min corona |
| 10 | 3.76 | 5.45 | 3.84 | 5.51 | 4.93 | 7.15 |

The invention has been described in detail with particular reference to preferred embodiments thereof, but it will be understood that variations and modifications can be effected within the spirit and scope of the invention.

We claim:

1. An electrophotographic charge generating element comprising, in order:

(a) an electrically conductive layer, (b) a photoconductor charge generating layer, and (c) a solid electrolyte layer comprising a silsesquioxane salt complex, and at least 0.2 weight % of a nondiffusible acid scavenger that is a tertiary arylamine having a pKa of at least 4 in water.

2. The element of claim 1 wherein said silsesquioxane salt complex has a ratio of carbon to silicon atoms of at least 1.1:1.

3. The element of claim 1 wherein said solid electrolyte layer comprises a silsesquioxane polymeric material selected from the group consisting of:

(a) a silsesquioxane represented by Structure I:

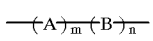

wherein -A- is represented by Structure Ia:

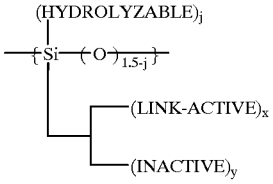

and -B- is represented by Structure Ib:

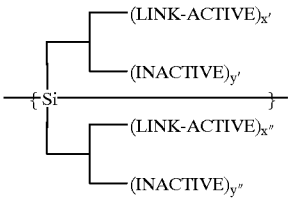

and (b) a mixture of polymers represented by Structures II and III:

II

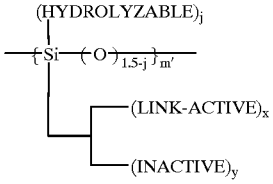

-continued

III

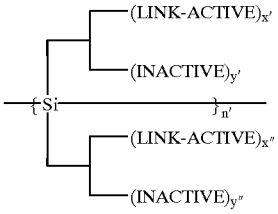

wherein $0 \leqq j \leqq 05$, m is from about 50 to 100 mole percent, n is from 0 to about 50 mole percent, m' is at least 10, and n' is at least 10, x+y, x'+y' and x"+y" are independently about 1, and (x+x'+x")/(x+y+x'+y'+x"+y") is less than or equal to 0.45, HYDROLYZABLE is hydroxy, hydrogen, halo, an alkoxy group having, 1 to 6 carbon atoms, an alkylcarboxy group wherein the alkyl portion has 1 to 6 carbon atoms, an -(O-alkylene)$_p$-O-alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

4. The element of claim 1 wherein said silsesquioxane has at least 20 silyl units and is represented by Structure IV:

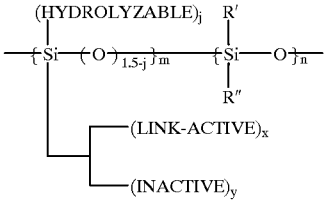

wherein $0 \leqq j \leqq 0.5$, m is from about 50 to 100 mole percent, n is from 0 to about 50 mole percent, x+y is about 1, x/(x+y) is less than or equal to 0.45, HYDROLYZABLE is hydroxy, hydrogen, halo, an alkoxy group having 1 to 6 carbon atoms, an alkylcarboxy group wherein the alkyl portion has 1 to 6 carbon atoms, an -(O-alkylene)$_p$-O-alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, R' and R" are independently alkyl groups having 1 to 10 carbon atoms or aryl groups having 6 to 10 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

5. The element of claim 4 wherein HYDROLYZABLE is hydroxy, R' and R" are both methyl, ethyl or phenyl, m is from about 50 to about 99 mole percent, and n is from about 1 to about 50 mole percent.

6. The element of claim 4 wherein the ACTIVE group further includes an oxy, thio, ester, imino or amino group.

7. The element of claim 1 wherein said solid electrolyte layer comprising said silsesquioxane salt complex further comprises a charge carrier.

8. The element of claim 7 wherein said charge carrier is LiCl, $CH_3COOLi$, $LiNO_3$, $LiNO_2$, LiBr, $LiN_3$, $LiBH_4$, LiI, LiSCN, $LiClO_4$, $LiCF_3SO_3$, $LiBF_4$, $LiBPh_4$, NaBr, $NaN_3$, $NaBH_4$, NaI, NaSCN, $NaClO_4$, $NaCF_3SO_3$, $NaBF_4$, $NaBPh_4$, KSCN, $KClO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$ or $CsBPh_4$ wherein "Ph" represents a phenyl group.

9. The element of claim 1 wherein said nondiffusible acid scavenger has a pKa of from about 4 to about 10, and is present in said solid electrolyte layer in an amount of from about 0.5 to about 50 weight %.

10. The element of claim 9 wherein said nondiffusible acid scavenger has at least one hydroxy group, a pKa of from about 4 to about 8, and is present in said solid electrolyte layer in an amount of from about 1 to about 30 weight %.

11. The element of claim 1 wherein said nondiffusible acid scavenger is represented by Structure V:

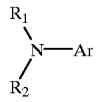

wherein $R_1$ and $R_2$ are independently hydrocarbon groups other than aryl groups having from 1 to 12 carbon atoms, and Ar is a substituted or unsubstituted carbocyclic aromatic group.

12. The element of claim 11 wherein said nondiffusible acid scavenger is represented by Structure VI:

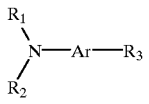

wherein $R_1$ and $R_2$ are independently hydrocarbon groups other than aryl groups having from 1 to 12 carbon atoms, Ar is a substituted or unsubstituted carbocyclic aromatic group, and $R_3$ is hydrogen, halo, or an organic group.

13. The element of claim 12 wherein $R_1$ and $R_2$ are independently alkyl groups having 1 to 12 carbon atoms, alkenyl groups having 2 to 10 carbon atoms, alkynyl groups having 2 to 10 carbon atoms, or cycloalkyl groups having 5 to 6 carbon atoms, or $R_1$ and $R_2$ together represent the carbon, oxygen, nitrogen and sulfur atoms necessary to complete a 3- to 10-membered ring with the nitrogen atom in Structure VI, Ar is a phenylene, naphthylene or anthrylene group, and $R_3$ is hydrogen, halo or an organic group having a molecular weight of at least 50 and includes one or more carbocyclic aryl groups, cycloalkyl groups, alkyl groups, alkenyl groups, alkynyl groups, aromatic or nonaromatic heterocyclic groups, or a combination of any of these.

14. The element of claim 13 wherein $R_1$ and $R_2$ are independently alkyl groups having 1 to 12 carbon atoms, and $R_3$ is an organic group having a molecular weight of at least 50, and at least one of $R_1$, $R_2$ and $R_3$ comprises a functional group selected from the group consisting of hydroxy, alkylcarboxy, isocyanato, epoxy amino, and silicon ester.

15. The element of claim 13 wherein $R_1$ and $R_2$ are independently an alkyl group having 1 to 4 carbon atoms, and at least one of them comprises one or more hydroxy, alkylcarboxy, isocyanato, epoxy, amino or silicon ester groups, Ar is a phenylene group, and $R_3$ is a triarylmethyl group that can also include one or more hydroxy, alkylcarboxy, isocyanato, epoxy, amino or silicon ester groups.

16. The element of claim 1 wherein said nondiffusible acid scavenger is one of the following compounds:

ACID SCAVENGER I

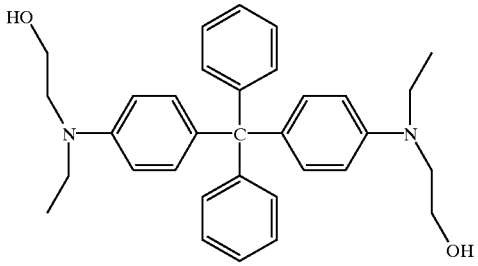

ACID SCAVENGER II

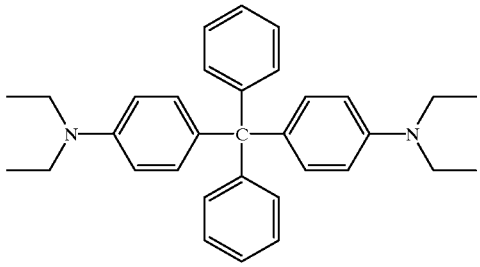

ACID SCAVENGER III

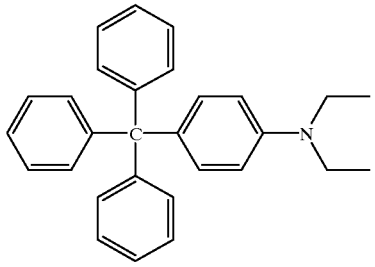

-continued

ACID SCAVENGER IV

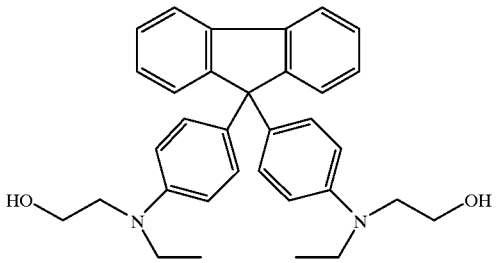

ACID SCAVENGER V

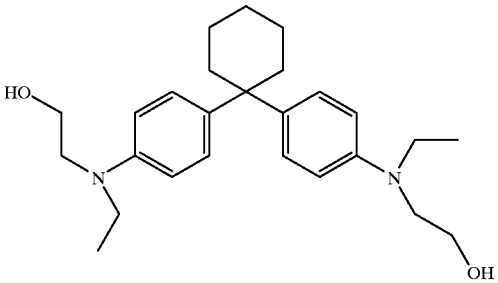

ACID SCAVENGER VI

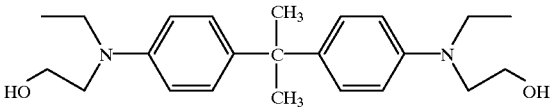

ACID SCAVENGER VII

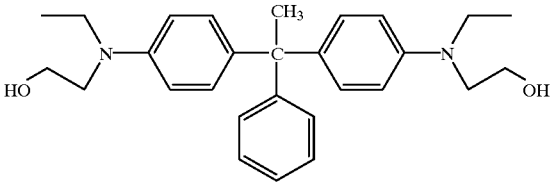

ACID SCAVENGER VIII

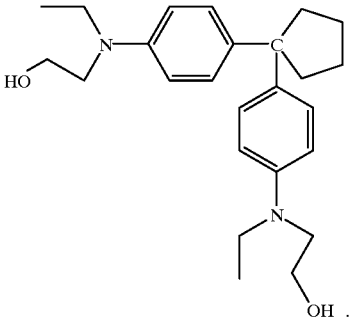

17. The element of claim 16 wherein said acid scavenger is Acid Scavenger I, IV or V.

18. A developed electrophotographic element comprising the electrophotographic charge generation element of claim 1 and a deposited image of electrophotographic toner.

19. An electrophotographic charge generating element comprising, in order:

(a) an electrically conductive layer, (b) a photoconductor charge generating layer, (c) a primer layer having a surface resistivity of at least $10^{10}$ ohms/square, and (d) a solid electrolyte layer comprising a silsesquioxane salt complex and from about 1 to about 30 weight % of a nondiffusible acid scavenger that is a tertiary arylamine having a pKa of from about 4 to about 8 in water.

20. The element of claim 19 wherein said silsesquioxane has at least 20 silyl units and is represented by Structure IV:

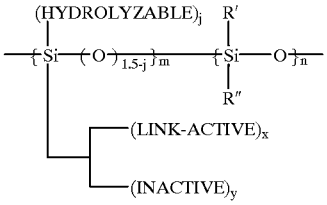

wherein $0 \leqq j \leqq 0.5$, m is from about 75 to 99 mole percent, n is from 1 to about 25 mole percent, x+y is about 1, x/(x+y) is less than or equal to 0.45, HYDROLYZABLE is hydroxy, hydrogen, halo, an alkoxy group having 1 to 6 carbon atoms, an alkylcarboxy group wherein the alkyl portion has 1 to 6 carbon atoms, an -(O-alkylene)$_p$-O-alkyl group wherein the alkylene portion is an alkylene group having 2 to 6 carbon atoms, the alkyl portion is an alkyl group having 1 to 6 carbon atoms and p is an integer of 1 to 3, or a primary or secondary amino group having 1 to 6 carbon atoms, R' and R" are independently alkyl groups having 1 to 10 carbon atoms or aryl groups having 6 to 10 carbon atoms, LINK is an alkylene group having 1 to 12 carbon atoms, a fluoroalkylene group having 1 to 12 carbon atoms, a cycloalkylene group having 5 to 10 carbon atoms in the ring or an arylene group having 6 to 10 carbon atoms in the ring, ACTIVE is a monovalent organic group having from 4 to 20 carbon, nitrogen, oxygen or sulfur atoms, that can be complexed with a charge carrier, and INACTIVE is a monovalent or divalent group having from 1 to 12 carbon atoms that cannot participate in siloxane polycondensation and does not transport charge.

21. The element of claim 20 wherein HYDROLYZABLE is hydroxy, R' and R" are both methyl, ethyl or phenyl, said ACTIVE group further includes an oxy, thio, ester, imino or amino group, and said silsesquioxane salt complex comprises a charge carrier that is LiCl, $CH_3COOLi$, $LiNO_3$, $LiNO_2$, LiBr, $LiN_3$, $LiBH_4$, LiI, LiSCN, $LiClO_4$, $LiCF_3SO_3$, $LiBF_4$, $LiBPh_4$, NaBr, $NaN_3$, $NaBH_4$, NaI, NaSCN, $NaClO_4$, $NaCF_3SO_3$, $NaBF_4$, $NaBPh_4$, KSCN, $KClO_4$, $KCF_3SO_3$, $KBF_4$, $KBPh_4$, RbSCN, $RbClO_4$, $RbCF_3SO_3$, $RbBF_4$, $RbBPh_4$, CsSCN, $CsClO_4$, $CsCF_3SO_3$, $CsBF_4$ or $CsBPh_4$ wherein "Ph" represents a phenyl group.

22. The element of claim 19 wherein said nondiffusible acid scavenger is one of the following compounds:

ACID SCAVENGER I
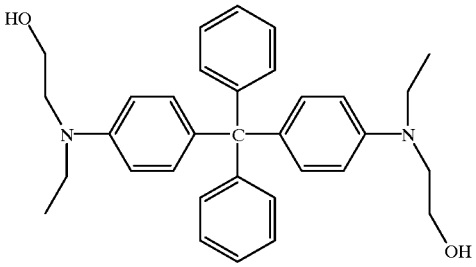
ACID SCAVENGER II
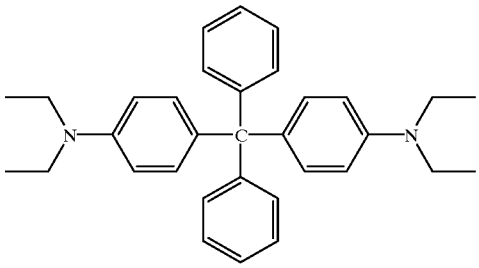
ACID SCAVENGER III
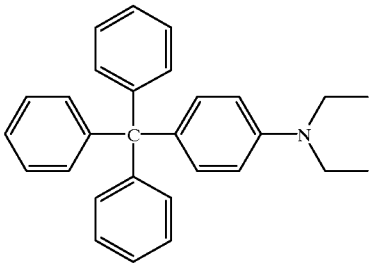
ACID SCAVENGER IV
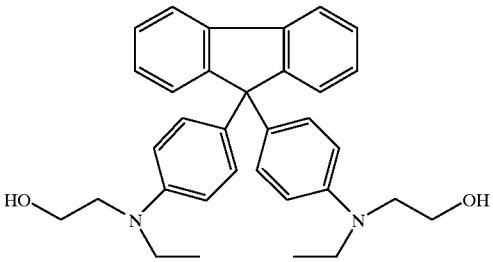
-continued
ACID SCAVENGER V
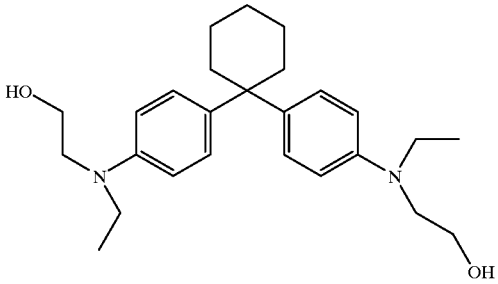
ACID SCAVENGER VI
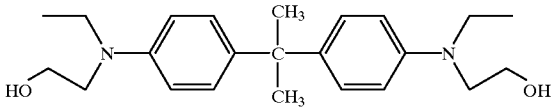
ACID SCAVENGER VII
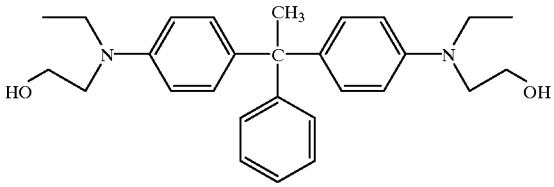
ACID SCAVENGER VIII
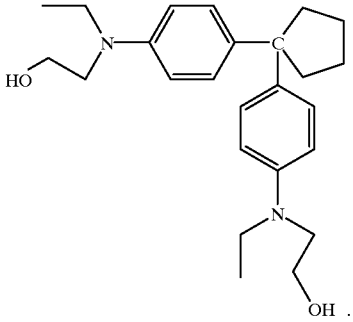
* * * * *

UNITED STATES PATENT AND TRADEMARK OFFICE

CERTIFICATE OF CORRECTION

PATENT NO. : 6,187,491 B1
DATED : February 13, 2001
INVENTOR(S) : Wayne T. Ferrar et al.

It is certified that error appears in the above-identified patent and that said Letters Patent is hereby corrected as shown below:

Column 26,
Line 12, delete "$0 \leqq j \leqq 05$" and insert -- $0 \leq j \leq 0.5$ --
Line 52, delete "$0 \leqq j \leqq 0.5$" and insert -- $0 \leq j \leq 0.5$ --

Column 30,
Line 19, delete "$0 \leqq j \leqq 0.5$" and insert -- $0 \leq j \leq 0.5$ --

Signed and Sealed this

Fourteenth Day of January, 2003

JAMES E. ROGAN
*Director of the United States Patent and Trademark Office*